US006229556B1

(12) United States Patent
Venkataraman

(10) Patent No.: US 6,229,556 B1
(45) Date of Patent: May 8, 2001

(54) PRINTER AND METHOD OF USING SAME TO PRINT ON THERMOPLASTIC MEDIUM

(75) Inventor: Ravi Venkataraman, Cookeville, TN (US)

(73) Assignee: Identity Group, INc., Cookeville, TN (US)

( * ) Notice: Subject to any disclaimer, the term of this patent is extended or adjusted under 35 U.S.C. 154(b) by 0 days.

(21) Appl. No.: 09/418,648

(22) Filed: Oct. 15, 1999

Related U.S. Application Data

(60) Provisional application No. 60/104,650, filed on Oct. 15, 1998.

(51) Int. Cl.[7] ..... B41J 11/42; B41J 11/44; B41J 11/46; B41J 2/32

(52) U.S. Cl. ..... 347/171; 347/218

(58) Field of Search ..... 347/218, 171, 347/221; 400/120.01, 125.16, 401.1, 579, 583.3, 582, 630; 271/226, 227, 241; 101/379, 327

(56) References Cited

U.S. PATENT DOCUMENTS

| | | | |
|---|---|---|---|
| 2,964,401 | 12/1960 | Plambeck, Jr. . | |
| 2,993,789 | 7/1961 | Crawford . | |
| 3,742,853 | 7/1973 | Landsman . | |
| 3,779,779 | 12/1973 | Landsman | 96/36.3 |
| 3,877,939 | 4/1975 | Okai | 96/36.3 |
| 3,981,583 | 9/1976 | Tsuchida et al. | 355/100 |
| 4,050,936 | 9/1977 | Takeda et al. | 96/28 |
| 4,064,205 | 12/1977 | Landsman | 264/25 |
| 4,087,182 | 5/1978 | Aiba et al. | 355/100 |
| 4,157,261 | 6/1979 | Takeda | 96/28 |
| 4,266,007 | 5/1981 | Hughes et al. | 430/306 |
| 4,286,043 | 8/1981 | Taylor, Jr. | 430/253 |
| 4,332,873 | 6/1982 | Hughes et al. | 430/15 |
| 4,444,607 | 4/1984 | Lash et al. | 156/58 |
| 4,576,898 | 3/1986 | Hoffman et al. | 430/306 |
| 4,647,524 | 3/1987 | Sullivan | 430/312 |
| 4,668,607 | 5/1987 | Wojcik | 430/281 |
| 4,725,853 | 2/1988 | Kobayashi et al. | 346/76 |
| 4,732,829 | 3/1988 | Sullivan | 430/11 |
| 4,733,249 | 3/1988 | Iwamoto et al. | 346/74.4 |
| 4,764,449 | 8/1988 | Vanlseghem | 430/162 |
| 4,897,327 | 1/1990 | Dubin et al. | 430/45 |
| 4,966,827 | 10/1990 | Sullivan | 430/270 |
| 5,035,981 | 7/1991 | Kurtz et al. | 430/327 |
| 5,181,787 | 1/1993 | Hosomi | 400/120 |
| 5,182,056 | 1/1993 | Spence et al. | 264/22 |
| 5,252,428 | 10/1993 | Kawamoto et al. | 430/271 |
| 5,266,426 | 11/1993 | Tsuchiya et al. | 430/15 |
| 5,300,351 | 4/1994 | Takahashi et al. | 428/207 |
| 5,366,302 | 11/1994 | Masumura et al. | 400/120 |
| 5,370,968 | 12/1994 | Goss et al. | 430/271 |
| 5,372,669 | 12/1994 | Freedman | 156/243 |
| 5,407,764 | 4/1995 | Cheema et al. | 430/15 |
| 5,414,450 | 5/1995 | Oshino et al. | 342/197 |

(List continued on next page.)

FOREIGN PATENT DOCUMENTS

| | | | |
|---|---|---|---|
| 0853004 | * | 7/1998 | (EP) . |
| 409109535A | | 4/1997 | (JP) . |
| 409216447A | | 8/1997 | (JP) . |
| 9-216447 | * | 8/1997 | (JP) . |

*Primary Examiner*—Huan Tran
(74) *Attorney, Agent, or Firm*—Reed Smith LLP

(57) ABSTRACT

The present invention is directed to a thermal printer and a method for using the printer for printing on thermoplastic foam to form a relief image which is comprised of open cells in the area that is the transfer ink enclosed or sealed cells which is to be impermeable to ink or other print medium. More particularly, the present invention relates to a printer having a thermal head or thermal imaging means and method of using the printer to form an image on a thermoplastic foam, the image being comprised of a relief image of open cells and a background image of closed cells.

20 Claims, 7 Drawing Sheets

U.S. PATENT DOCUMENTS

| | | | |
|---|---|---|---|
| 5,460,757 | 10/1995 | Hedgecoth | 264/400 |
| 5,554,334 | 9/1996 | Kashio et al. | 264/293 |
| 5,559,545 | 9/1996 | Fuwa | 347/171 |
| 5,577,444 | 11/1996 | Toyama | 101/379 |
| 5,665,524 | 9/1997 | Kashio et al. | 430/300 |
| 5,677,721 | 10/1997 | Suzuki et al. | 347/190 |
| 5,750,315 | 5/1998 | Rach | 430/306 |
| 5,776,661 | 7/1998 | Casaletto et al. | 430/306 |
| 5,887,996 * | 3/1999 | Castelli et al. | 400/579 |

* cited by examiner

PRINTER AND METHOD OF USING SAME TO PRINT ON THERMOPLASTIC MEDIUM

This application claims the benefit of the earlier filing date of provisional application No. 60/104,650 filed on Oct. 15, 1998.

FIELD OF THE INVENTION

The present invention relates generally to a printer and a method for using the printer for printing an image on a thermoplastic medium. More particularly, the present invention relates to a printer having a thermal head or thermal imaging means and method of using the printer to form an image on a thermoplastic foam, the image being comprised of a relief image of open cells and a background image of closed cells.

BACKGROUND OF THE INVENTION

A number of traditional ways exist for forming images on a printing plate. These include, but are not limited to, molding, photoflash imaging, and thermal imaging. The present invention is directed broadly to the area of thermal imaging or thermography. Thermal imaging or thermography is a process wherein an image is generated by the use of image-wise modulated thermal energy. Traditionally, "direct thermography" refers to a method whereby a visible image pattern is formed by the image-wise heating of a recording material containing matter that by chemical or physical process changes color or optical density. Most of the direct thermographic recording materials are of a chemical type. Upon heating the recording material to a certain conversion temperature, an irreversible chemical reaction takes place and a colored image is produced.

In recent years, the field of manufacturing or producing printing plates (e.g., rubber stamps) has experienced rapid advancement. Resinous relief printing plates, planographic printing plates, and intaglio printing plates all formed using photosensitive resins now enjoy widespread use. In addition, a number of methods are known for forming printing plates using stencil images. These methods generally involve the use of a thermal printer or a wire dot printer to form a stencil image on a sheet, which is then utilized as a printing plate.

As the use of relatively simple printing systems has expanded, the need for a simple, yet reliable, method of printing a printing plate has come into existence. In an attempt to address this need, U.S. Pat. No. 5,665,524 (which is hereby incorporated herein in its entirety by reference) describes a printing plate which is formed from an open celled thermoplastic medium wherein the open cells are sealed upon exposure to energy rays. The methods described in this reference generally require the presence of a negative to block photorays which results in a portion of the photosensitive thermoplastic medium remaining unhardened by the blocking of the energy rays, and a separate portion which is hardened by exposure to the energy rays. The exposed portion forms a background of the image to be formed on the stamp. The background portion prevents the transfer of ink from the thermoplastic foam to the receiving medium (i.e., paper) in these regions. It is speculated in U.S. Pat. No. 5,665,524 that an expensive laser system may be driven to seal predetermined portions of the foam to form the background image. This reference also places a great deal of emphasis on forming the open-cell image in the same plane as the background image by sealing only a surface layer of open cells, thereby forming a plate having little or no relief.

SUMMARY OF THE INVENTION

One embodiment of the present invention is directed to a printer for printing on a thermoplastic medium, wherein the printer is generally comprised of a housing or frame which functions as a support structure for the mechanical pieces of the printer. The printer includes a thermal head or thermal printing means which is generally attached to the frame and which functions as a source of thermal energy to be placed in contact with selected portions of the thermoplastic medium. The term "contact" or "direct thermal contact" as defined herein with regard to the formation of an image on a thermoplastic medium is very similar to "direct thermography" as known in the related art, except that the recording material is an open-celled thermoplastic material and the chemical or physical change is the closing or sealing of the open-cells to form a background image. When the thermal head is placed in "direct" contact with the thermoplastic medium, the thermal head heats and melts selected portions of the thermoplastic medium. "Direct thermal contact" does not mean that the thermal head or the thermal imaging means must be in physical contact with the thermoplastic medium but rather the thermal energy generated must be in sufficient contact with the thermoplastic material so as to cause a physical change (e.g., melting) of the thermoplastic medium.

The heated or melted portions of the thermoplastic medium are sealed (that is the open cells of the thermoplastic medium are closed), which results in the formation of a background image or non-image on the thermoplastic medium. The sealed or closed portions are substantially impermeable to the printing fluid (ink). Although the printer is described in specific detail and with reference to specific embodiments herein, it is to be understood that the present invention should not be so limited and can be incorporated into a large number of different embodiments with each of them sharing the contact of a thermal energy on thermoplastic foam, whereby a relief is formed on the thermoplastic foam.

In the present invention, it is preferable, although certainly not requisite, to utilize a thermoplastic material which contains an ink constituent at a predetermined concentration. The thermoplastic resin sheet is preferably open-celled. "Open-celled" refers to a continuous cell structure where the cells communicate directly or indirectly with other cells in the thermoplastic resin sheet, whereby liquid can pass from cell to cell. "Open-cell" may be used herein to interchangeably refer to the characteristic of the thermoplastic medium and to the fact that the cells of the thermoplastic medium have interstitial spaces which may be filled with an ink constituent. "Open-celled" refers to microporous and porous structures within the thermoplastic medium which are sufficiently sized to store and/or transfer ink and which communicate either directly or indirectly with each other and therefore which may function to transfer ink to the material to be printed on. "Closing", "solidification", "melting", "sealing", "thermalizing" or "hardening" of the surface of the thermoplastic medium are all terms that may be used herein to refer to the substantial elimination of open cells in a specific area which renders that portion of the thermoplastic medium impermeable to an ink constituent. Generally, the thermoplastic medium is a flat sheet having a predetermined length, width, thickness and density.

When mounted in a hand stamper, the thermoplastic medium effuses ink when pressure is applied. Eliminating the necessity of inking the printing plate after the image is formed is one advantage of the present invention. Another advantage is the fact that a large number of oddly shaped stamps can be formed, which based on the layout/template formed reduces the mess normally present when using such ink pads. Additionally, by inking at the desirable saturation levels of the thermoplastic material, the pre-inked thermoplastic material can be used in standard thermal head printers without concern for unwanted effusion of the ink out of the foam during the processing of the thermoplastic material. To further prevent undesirable effusion of ink onto the printer a thermal transfer ribbon, for example, available from Markem TTR, Part No. 81716002135 MJ, 716 Black 00, Lot No. 5980A6, 135MMX300M, may be used between the thermoplastic foam and the printer head or thermal head. Even minimally pre-inking the thermoplastic material allows for better "wicking" of the ink. This condition improves the capillary action of the thermoplastic material. As a result, if the printing plate or thermoplastic material is more fully inked after the image is formed, the capillary action is much faster and thus the absorption of the ink occurs in a much more timely manner.

Disclosed herein is a printer capable of and specifically designed for printing on a thermoplastic medium. In general, the printer includes a driving mechanism operatively connected to a frame for driving the thermoplastic medium across and in thermal contact with a thermal head. The driving mechanism is preferably a cylindrical platen or roller which frictionally engages the thermoplastic medium and feeds the thermoplastic medium into the printer and across the thermal head. The driving mechanism may include O-rings or other engaging means for driving a pallet or template through the printer. Preferably, the printer includes a cam assembly which is utilized in biasing the thermal head against the thermoplastic medium. The thermal head engages the thermoplastic medium on the surface which is to be printed on and the platen, roller or O-ring pushes the thermoplastic medium against the thermal head. The printer may include adjustable guide rails operatively connected to the frame which are designed to adjustably accommodate a variety of widths and thicknesses of thermoplastic medium and/or pallets. The guide rails assist in properly guiding the thermoplastic medium onto the printer receiving bed and across the thermal head. The template may be used alone or in combination with the guide rails. For example, the printer may have a predetermined cross-sectional width which exists between the sidewalls and the template may be interposed between the side walls with a predetermined dimension cut out to accommodate any desired end product. Within the template is a predetermined layout which is designed to accommodate individual pieces of thermoplastic material.

As used in this disclosure, "thermoplastic recording material" or "thermoplastic medium" means an organic material, normally a polymer, which exhibits plasticity at some stage of manufacture and which can be shaped by application of heat and/or pressure. The "thermoplastic resin" or "thermoplastic medium" preferably includes or is comprised of "open-celled" material. The thermoplastic material itself is preferably a polyethylene, and more preferably, an ethylene-olefin copolymer. However, polyurethanes, polyacetals, polystyrenes and polyamides may also be used. The levels of saturation of the thermoplastic medium and the amount of ink constituent held within the thermoplastic medium may vary depending on, among other things, the specific density of the ink constituent, the type and density of polymer used, and the degree of porosity in the thermoplastic sheet.

As used in this disclosure, the term "about" means ±10% of a numerical value, i.e., "about 20%" means 18–22%. As used herein, "complete saturation" means complete or maximum absorption of an ink constituent by a thermoplastic recording material.

Although this disclosure focuses on a thermal head printer, as used in this disclosure, the terms "energy beam" or "energy ray" as sometimes used hereinafter refer to any ray, beam, radiation or light which is capable of supplying thermal energy to an open-celled sheet, and is preferably selected from ultraviolet rays, infrared rays, visible rays and electron rays. Preferable sources of the energy rays include flash lamps, strobe lamps, laser generators and the like. Of course, a wide variety of rays, beams, radiation, and types of light, together with their associated sources may be employed. The printing plate of the present invention may be obtained either by attaching to the open-celled sheet a mask film capable of selectively intercepting the energy rays and then applying the energy rays over the mask, or may be obtained by direct thermal contact with a thermal head printer, electron beam generator, or laser beam. A pattern of image and non-image areas on the open-celled sheet is then formed by selectively applying the thermal energy rays resulting in a printing plate.

Additionally, the templates can be attached together for continuing processing of multiple printing plates. The present invention is very fast and there is a great deal of flexibility in the image to be printed on the printing plate due to the limitless numbers and types of software from which an image can be printed. The present invention reduces the cost associated with the formation of printing plates by, for example, eliminating the need for a mask to block photorays, allowing "off-the-shelf" software to be utilized, increasing speed of production, eliminating steps in the production process and eliminating cost prohibitive production equipment.

BRIEF DESCRIPTION OF THE DRAWINGS

These and other features of the invention will be more fully appreciated with reference to the figures and the disclosure to follow wherein.

DETAILED DESCRIPTION OF THE PRESENT INVENTION

Disclosed herein is a printer designed for printing on a thermoplastic medium. In general, the printer includes a driving mechanism operatively connected to a frame for driving the thermoplastic medium across and in thermal contact with a thermal head. The driving mechanism is preferably a cylindrical platen or roller which frictionally engages the thermoplastic medium and feeds the thermoplastic medium into the printer and across the thermal head. The driving mechanism may include O-rings or other engaging means for driving a pallet or template through the printer. Preferably, the printer includes a cam assembly which is utilized in biasing the thermal head against the thermoplastic medium. The thermal head engages the thermoplastic medium on the surface which is to be printed on and the platen, roller or O-ring pushes the thermoplastic medium against the thermal head. The printer may include adjustable guide rails operatively connected to the frame which are designed to adjustably accommodate a variety of widths and thicknesses of thermoplastic medium, the guide rails assist in properly guiding the thermoplastic medium onto the receiving bed and across the thermal head. Alternatively, or in combination with the guide rail, a standard size pallet may be used which fits within the printer. For example, the printer may have a predetermined cross-sectional width which exists between the sidewalls and the template may be interposed between the side walls with a predetermined dimension cut out to accommodate any desired end product.

Figure 1:
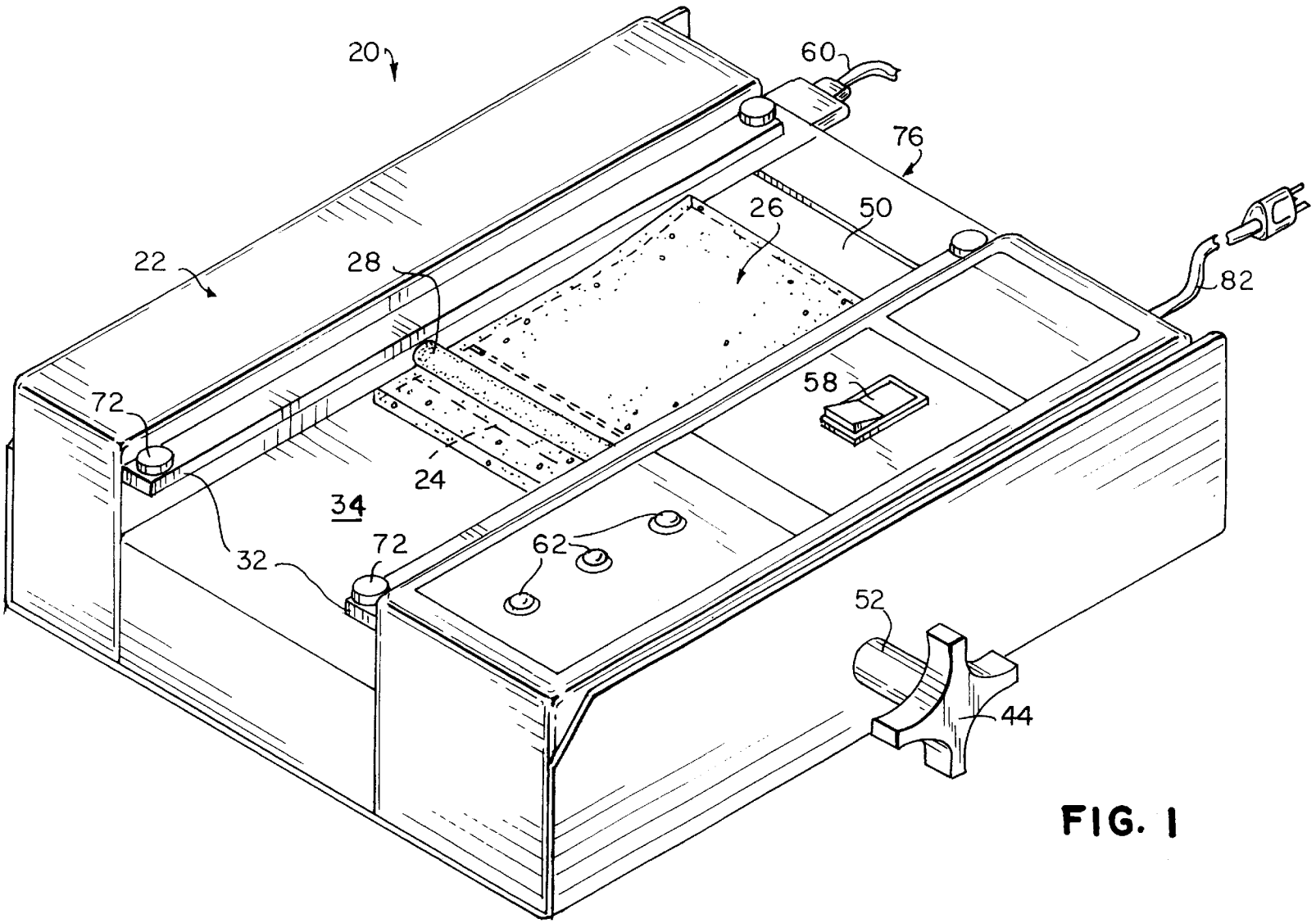
FIG. 1 is an isometric view of a preferred embodiment of the thermal printer illustrated with a piece of thermoplastic medium on the receiving bed of the printer.
Figure 4:
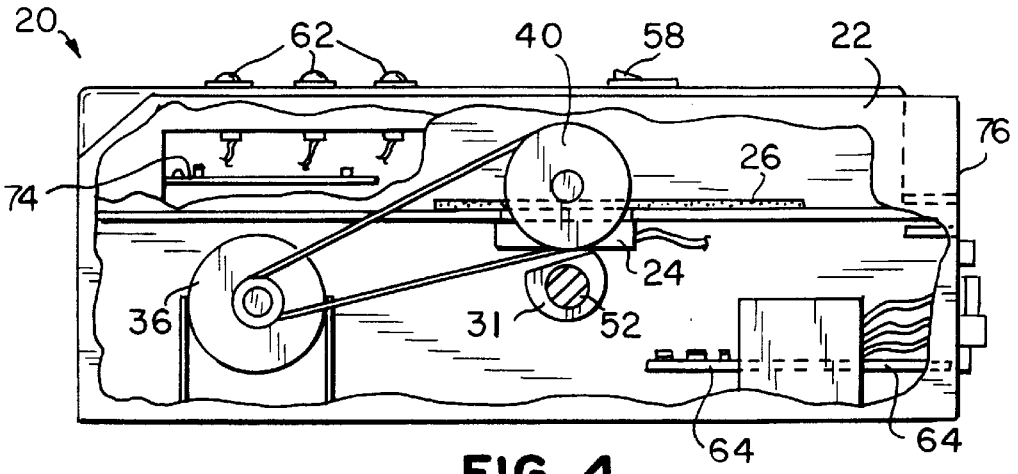
FIG. 4 is a right side view of a preferred embodiment of the thermal head printer with a cut-away portion illustrating the interior assembly of the printer.
Figure 6:
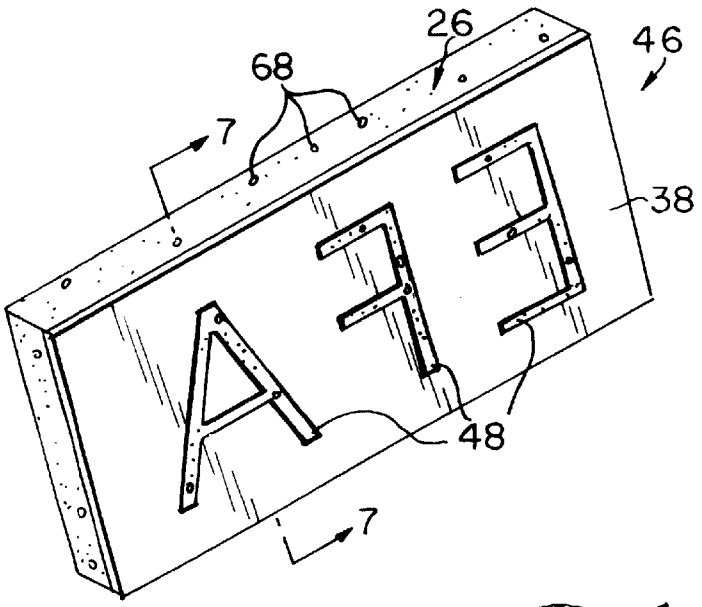
FIG. 6 is an isometric view of a printing plate illustrating the raised open-cell ink face area and the sealed background image.

In order that the invention herein may be described and understood more fully, the following detailed description with reference to the drawings is set forth. Referring to FIG. 1, a printer 20 for printing an image 48 on a thermoplastic medium 26 or thermoplastic foam 26 is illustrated. The printer 20 is very generally comprised of a frame or housing 22 which houses the mechanical assembly of the thermal head printer 20 which at least includes a thermal head or thermal print head 24 attached to the housing 22. Thermal head 24 is preferably pivotally mounted so that it may be biased against the thermoplastic foam 26 in order for thermal energy to be applied to the thermoplastic medium 26. Cam 31 functions to bias or press the thermal head 24 against the thermoplastic medium 26 in order to allow the thermal energy to be placed in contact with the thermoplastic medium 26 (FIG. 4). This allows the production of open-celled image 48 and background image 38 on printing plate 46 (FIG. 6). In the released or non-printing mode, in the embodiment shown in FIG. 1, cam 31 is adjusted via rotatable handle 44 and cam lever shaft 52 so that the thermal printhead 24 is not in thermal contact with the thermoplastic medium 26.

Figure 5:
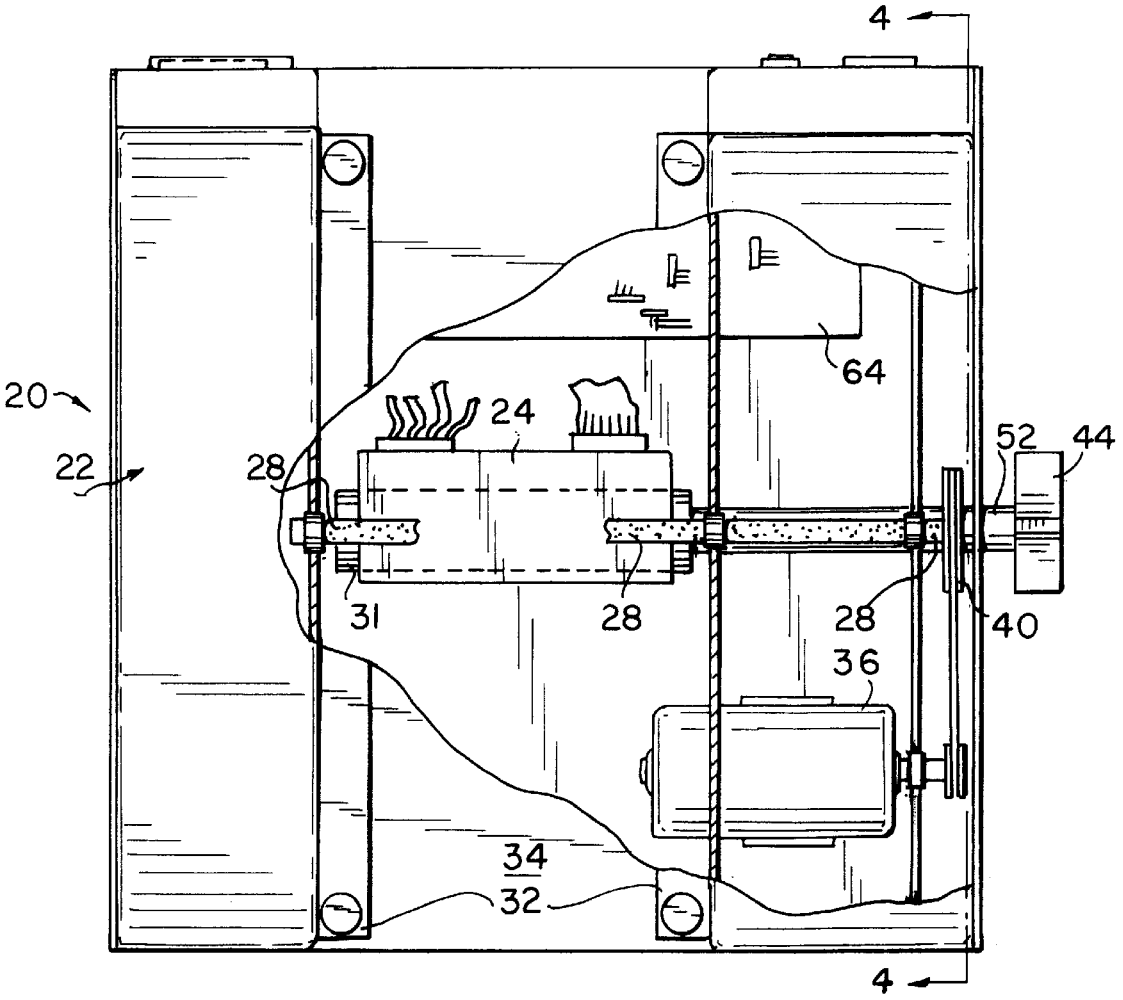
FIG. 5 is a top plan view of a preferred embodiment of the thermal head printer with a cut-away portion to illustrate the interior assembly of the printer.

Referring to FIGS. 5 and 6, "direct" thermal printing results when a thermal printhead 24 receives an imaging signal in the form of electrical pulses from a driver circuit 64. Thermal printhead 24 generally consists of microscopic heat resistor elements which convert the electrical energy into heat via the joule effect. The electrical pulses thus converted into thermal signals manifest themselves as heat transferred to the surface of the thermal recording material, in this case, thermoplastic medium 26. As will be described hereinbelow, melting occurs at the surface of the thermoplastic medium 26 resulting in a background image or non-image 38 formed of sealed or closed cells and image 48 of open cells to be formed. Preferably, the areas of thermoplastic medium 26 which are to form background image 38 reach a temperature sufficient to cause melting or sealing of the cells in these areas. It is preferable that the sufficiency of heat transfer to the termoplastic medium 26 is enhanced by "squeezing" the thermoplastic medium 26 between the thermal head 24 and the platen or roller 28. Of course, the operational temperature and pressure applied to the thermoplastic medium 26 may vary depending on a particular thermoplastic medium 26 being used. The image signals for modulating the current in the microresistors in the thermal print head 24 are obtained directly for example from scanning devices or from intermediate storage means (e.g., magnetic disk, tape or optical disk storage medium) optionally linked to the digital image work station or microprocessor (not shown) via connector cord 60 wherein the image information can be processed to satisfy a particular need. Preferably, the microresistors fire at the same spot, multiple times before advancing, resulting in a deeper and cleaner seal.

Figure 8:
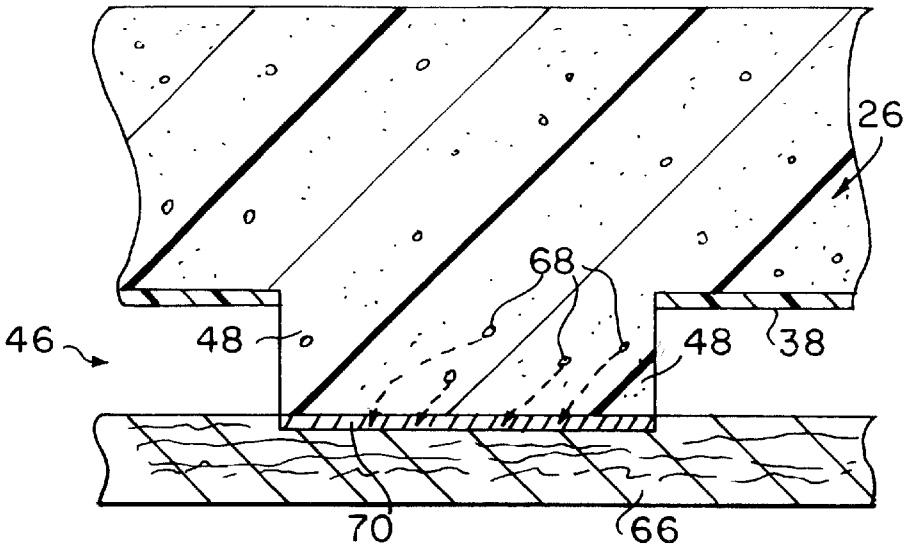
FIG. 8 is a highly enlarged cross section through line 7—7 of FIG. 7 illustrating a letter of the image plate being pressed against absorbent material to be printed on wherein the capillary action of ink flow is illustrated via dashed arrows for purposes of clarity.
Figure 7:
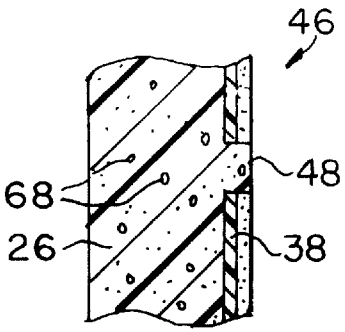
FIG. 7 is a partial cross section through line 7—7 of FIG. 6 illustrating an enlarged area of a letter in the printing plate.

Thermoplastic medium 26 can be selected from a number of thermoplastic resins, including by way of example, and without limitation, polyolefins, polyurethanes, polyacetals, polyethylene, polystyrene, and polyamide and combinations thereof. A thermoplastic medium 26 which has been found to be particularly useful for the present invention is an ethylene-olefin copolymer available, for example, from the Exxon Chemical Company. It is preferable that the thermoplastic medium 26 be "open-celled" prior to the application of heat. The open cells 68 are illustrated in FIGS. 6–8 as large "pores". Although, as illustrated and described herein, the material to be printed on 66 is described as absorbent, this is simply the most common application of the present invention. However, the present invention may be used to print on glass, PVC, and other "non-absorbent" materials. "Open cells" include microporous structures which are sufficiently sized to store or transfer ink. Individual open cells 68 are able to communicate directly with other cells or pockets in the thermoplastic foam. This allows a liquid print medium (ink) or an emulsion resin to pass from cell 68 to cell 68. This is illustrated by the dotted arrows in FIG. 8. As the ink leaves the open cells 68 of the print plate 46, an ink image 70 is formed on material 66, normally ink absorbing paper.

When thermal energy is applied to the surface of the thermoplastic foam 26, the surface of the thermoplastic foam 26 melts or solidifies resulting in a melted portion 38 of the thermoplastic foam 26 which eliminates communication between the open cells 68 of the print plate 46 and the print medium 66 due to the impermeable portion 38. Since portion 38 is substantially impermeable to liquid transfer, these areas are suitable in functioning as non-image areas which do not transfer ink to paper 66 as a background.

As stated above, melting or solidifying a surface portion of the thermoplastic medium 26 results in a background image 38 of the thermoplastic foam, substantially preventing communication between the underlying open cells and the paper 66. This is clearly illustrated in FIG. 8. To form the image 48 on the thermoplastic medium 26, the thermoplastic medium 26 is received by the receiving bed 34 of the printer 20 and fed into printer 20. Receiving bed 34 is generally a planar surface but may also be comprised of a convoluted path common in thermal head printers used for processing paper. It should be noted, however, that if a convoluted path is used as receiving bed 34, distortion in the resulting image 48 and lack of flexibility in the thermoplastic medium 26 are some of the issues which need to be addressed. Edge-fixed thermal print heads are preferred because the majority of the head is planar and thus the thermoplastic medium 26 does not encounter a convoluted path prior to an image being formed thereon. Adjustable guide rails 32 assist in guiding the thermoplastic medium 26 onto the receiving bed 34 and into the region where the thermal head 24 is to be placed in contact with the surface of the thermoplastic medium 26 where the image 48 and non-image 38 are to be formed.

The width of the thermoplastic medium 26 utilized depends on the width and number of stamps being formed along the surface area and the width of the thermal head 24. Typically, the width of the thermoplastic foam varies from about ¼ inch to about 4½ inches, with about 4 inches being most common. The length of the thermoplastic medium 26 can be essentially infinite and the printer 20 can be adapted to run continuous long lengths of thermoplastic medium 26 or a single stamp having very minimal length (i.e., about ¼ inch to about 1 inch). The thickness or depth of the thermoplastic foam is preferably in the range of about 0.1 inch to about 0.5 inches, more preferably about 0.15 inches to about 0.3 inches, and most preferably about 0.25 inches. The roller 28 may be adapted so that the thermoplastic medium 26 is capable of being placed in frictional engagement with the platen roller and the platen roller 28 to move the thermoplastic foam 26 along the receiving bed 34 and into contact with thermal print head printer 24. In the alternative, the O-rings 207 shown in FIG. 14 can be used to frictionally engage pallet 203 within grooves 204 to drive the thermoplastic medium 26 through the printer 20.

As best shown in FIG. 4, the thermal head 24 is pivotally mounted to housing 22 to be pivoted and biased against the thermoplastic medium 26 via cam 31 which is driven by cam shaft 52 via rotatable handle 44. Pulley system 40 drives platen roller 28. Pulley system 40 is itself driven by a step motor 36 at a predetermined speed based on the image 48 and background image 38 to be formed on the thermoplastic foam 26. The speed is normally communicated via drives circuit 64 and the print operation is monitored via control monitor board 74. As briefly discussed above, the driving mechanism or platen roller 28 drives the thermoplastic medium 26 across the thermal head 24 via frictional engagement at a predetermined rate and the thermal head 24 is biased against thermoplastic medium 26 via biasing means 31 which is illustrated as cam 31. Cam 31 is moved into place via rotatable handle 44 which when adjusted, moves cam shaft 52. To enhance frictional engagement between the thermoplastic material 26 and platen roller 28, platen roller 28 or the O-rings 207 may be textured or knurled.

Figure 2:
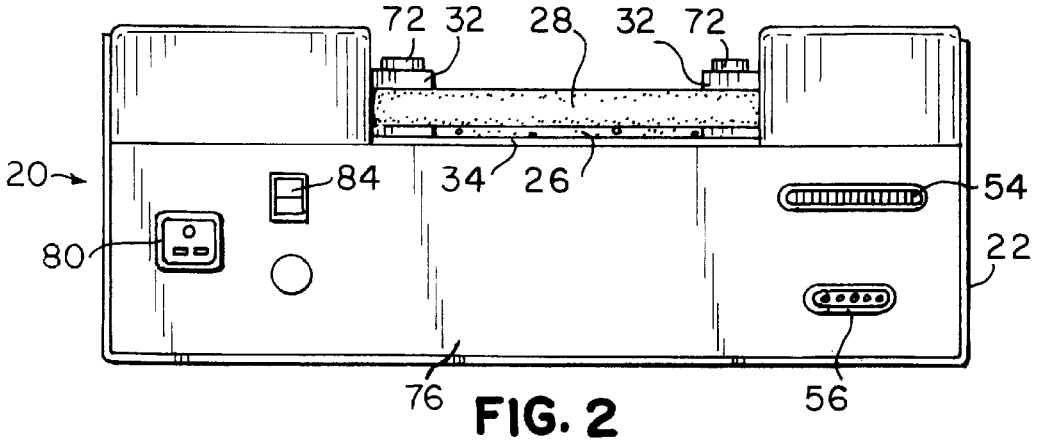
FIG. 2 is a rear view of a preferred embodiment of the thermal head printer of the present invention.
Figure 3:
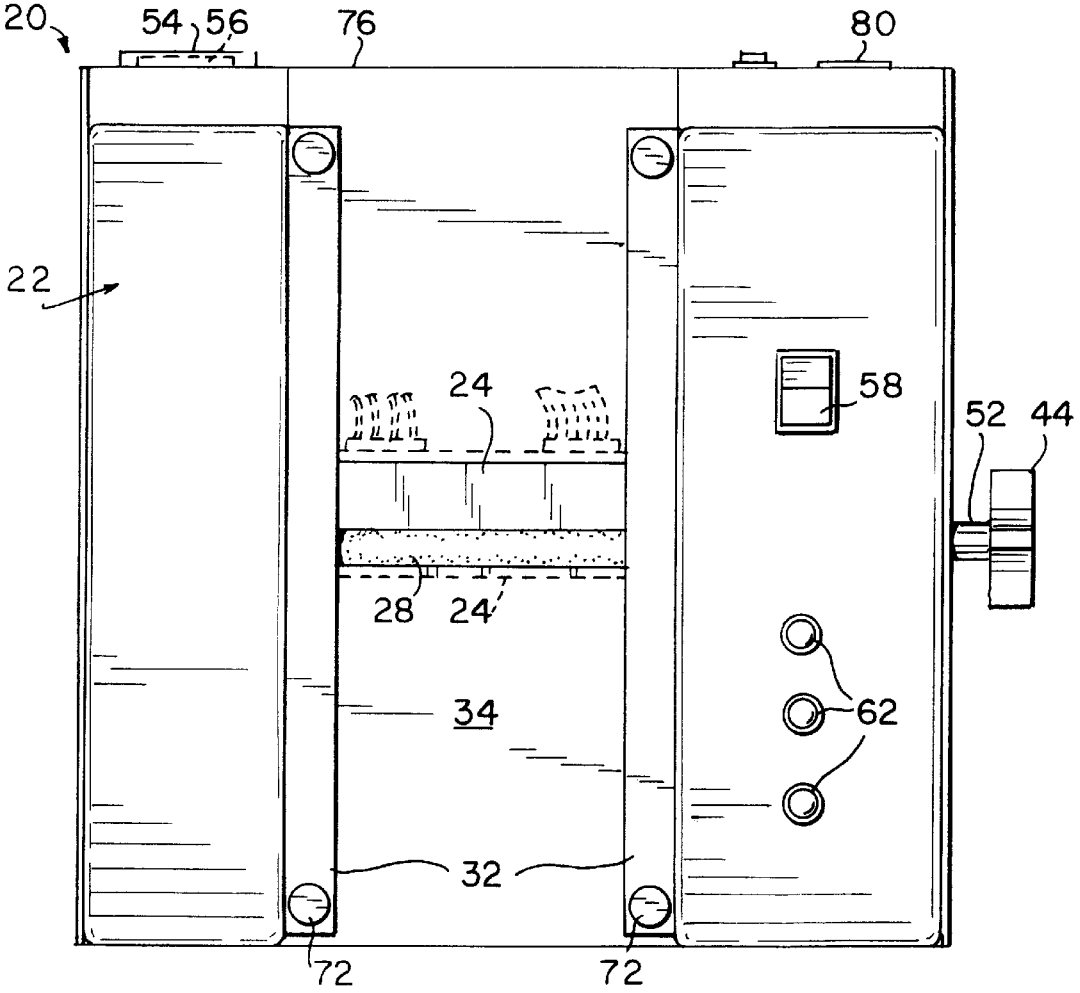
FIG. 3 is a top plan view of a preferred embodiment of the thermal head printer of the present invention.

Now referring to FIG. 2, the printer 20 is illustrated having both a parallel port 54 and a serial port 56 to allow communication with a variety of input sources such as scanners or graphical imaging software which resides on a microprocessor (not shown) via connector 60. Rear panel 76 includes a power jack 80 for connection to a power source via power cord 82. Fuse 84 provides protection from electrical overload. The communication ports provide means to communicate with printer 20. FIG. 3 illustrates the positioning of the on/off button 58 and star shaped handle 44 which biases the cam 31 against the thermal head 24 via cam shaft 52. Indicator lights 62 provide a visual indicator of the operation of printer 20. The placement of the button 58 and like devices are not crucial to the operation of the printer 20.

Referring in particular to FIGS. 6–8, the printing plate 46 formed by the direct thermal imaging process described herein is illustrated. On the surface of the printing plate 46, which is in direct contact with the thermal head 24, thermoplastic foam 26 is melted or solidified resulting in a melting of the open cells of the thermoplastic foam 26 to form a non-image 38 which is impermeable to the transfer of liquid or resin while the image portion 48 (lettering) maintains an open cell structure which permits the transfer of liquid or resin from the thermoplastic foam 26 to the material 66 to be printed on. This results in the image signals from the microprocessor to be printed on the print material 66. Pressure exerted on the thermoplastic foam 26 by the platen roller 28 results in portions of the thermoplastic foam 26 which are heated and melted being on a lower plane than the open celled structures which form the image 48. As shown in FIG. 8, after the desired image 48 is formed on the printing plate 46, printing ink is infused into the open cells of the printing plate 46. Ink can fill the entire open celled structure of the thermoplastic medium 26 except the melted or solidified surface portion 38 and can communicate with the paper or print medium 66 except in those areas 38 that are melted and sealed.

It may also be possible to infuse the ink prior to forming image 48 and background 38. The ink is illustrated as moving via capillary action along dotted arrows in FIG. 8. This is illustrated this way simply for clarity. The ink moves from one cell 68 to the next and may in fact take a very circuitous route to the material to be printed on 66. In this embodiment, referring in particular to FIGS. 1–8 and FIGS. 11 and 12, the printing plate 140 discussed herein as formed by a thermal imaging process which seals open cells 132 is illustrated. The surface of the thermoplastic foam 130, which is in contact with the energy, is melted or solidified resulting in a melting of the open cells 132 of the thermoplastic foam 130 to form a non-image 134 which is impermeable to the transfer of liquid or resin while the image portion 138 (lettering) maintains an open cell 132 structure which permits the transfer of liquid or resin 136 from the printing plate 140 to the material to be printed on. The portions 134 of the thermoplastic foam 130 which are heated and melted are normally on a lower plane than the open celled image forming portion 138. Thus the image 138 is formed as a relief of open cells 132.

It is preferable that the ink constituent 136 be absorbed or placed into the thermoplastic foam 130 prior to the formation of the image (sealed non-image portion 134 and open-celled image portion 138) on the printing plate. Ink generally fills the entire open celled structure of the thermoplastic medium 130 except in those melted or solidified surface portion 134. Accordingly, the ink 136 can be transferred to the paper or print medium except in those areas 134 that are melted and sealed.

Figure 10:
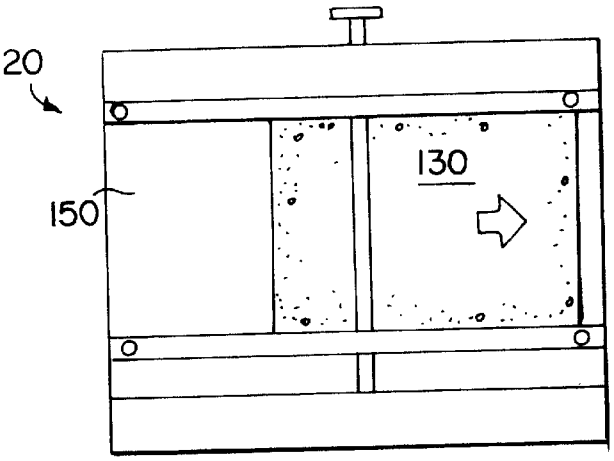
FIG. 10 is a top plan view of the pre-inked thermoplastic medium of the present invention being processed by a thermal head printer.

An image forming process is illustrated in FIG. 10 where the thermoplastic foam 130 is placed on a receiving bed 150 of a thermal head printer 20 and a thermal head (not shown but located below the thermoplastic foam 130) is driven to form the desired image (sealed non-image portion 134 and open-celled image portion 138) on printing plate 140. The imagewise modulated energy is applied directly to the surface of the thermoplastic foam 130.

The ink constituent 136 contained within the thermoplastic foam 130 is preferably at a predetermined concentration, whereby the ink constituent 136 does not egress out of the foam 130 without force or pressure being applied to the foam 130. It is preferable that the force exerted on the thermoplastic foam 130 as it is being processed does not cause ink 136 to egress out of the foam 130. This is beneficial in that, when the foam 130 is being processed through, for example, a thermal head printer 20 as shown in FIG. 10, the foam 130 does not release the ink constituent 136 prior to the image being formed thereon. Therefore, it is preferable that the predetermined concentration of the ink constituent 136 be at a lower level than that necessary to completely saturate the thermoplastic recording material 130. The optimal saturation level depends on a number of factors, including, but not limited to, type, density, viscosity, surface tension, etc. of the ink, and type and density of thermoplastic recording material 130. Although specific examples are provided herein, it is to be understood that the present invention is not to be so limited. The thermoplastic medium 130 is preferably pre-inked within the saturation levels for optimum conditions, such as minimal mess (egress of ink 136) on the printer and sharp, clear, clean images being formed on printing plate 140.

The printing plate 140 which is formed in accordance with the present invention is formed by placing a thermoplastic material 130 in sheet form in contact with an ink constituent 136 to thereby form a partially saturated thermoplastic medium 130, wherein the thermoplastic medium 130 is at least partially saturated with ink constituent 136. After the step of placing and soaking the thermoplastic material in an ink constituent 136, thermal energy is applied to selected areas of the partially saturated thermoplastic medium 130 to thereby form a background image 134 on said printing plate 140. The partially saturated thermoplastic medium is comprised of a thermoplastic foam 130 which is subject to absorbing ink and is preferably saturated less than 100%, preferably in the range of about 50% to about 80%, and even more preferably in the range of about 70% to about 80% saturation with said ink constituent 136. The backside (not shown) of the thermoplastic foam 130 may optionally include a gripping means, such as a sheet of felt (not shown) attached thereto. The felt is useful in processing the thermoplastic foam 130 through the printer (i.e., thermal head printer 20).

More specifically, the pre-inked thermoplastic medium printing process will be briefly described with reference to FIGS. 9–12. In the present invention, the thermoplastic medium is effused with ink. The surface of the pre-inked thermoplastic medium 130 is then treated, i.e., is melted and sealed at least at the surface layer, and more preferably, melted at sufficient depth or at a plurality of layers to form the sealed or closed portion 134 as a depressed portion and the open cell image 138 as a relief image. Not sealing the entire space behind the open cells 132 allows the open cells 132 behind the sealed cells to be repositories of printing fluid. The background portion 134 corresponds to the non-image portion of the original image and substantially prevents transfer of printing fluid 136 through the pre-inked thermoplastic medium in these areas. The areas of the pre-inked thermoplastic medium 130 which are not in contact with the heating elements (i.e., laser or modulated thermal energy) are generally formed as a mirror image of the image to be printed on a print material, and as a mirror image of the image viewed on a screen. This results in the proper translation from screen to stamp to paper.

The image portion 138 of the printing plate 140 which is to function as an area of ink 136 effusion is comprised of open cells 132. Therefore, when placed in contact with a material to be printed on, an ink constituent 136 or similar material is transferred from the open cells 132 of the image 138 to the paper in the desired pattern. Thus, when the thermoplastic material 130 is mounted as a printing plate 140 in, for instance, a hand stamper, the open cell 132 portions of the thermoplastic medium 130 are able to transfer ink to the material to be printed on, i.e., paper, in those regions 138 which do not contain a layer of sealed cells 134. Conversely, the sealed portions 134 prevent the transfer of ink.

One type of device or procedure utilized to seal the open-cell thermoplastic material is direct thermal imaging via a thermal head printer 20 as shown in FIG. 10. The thermal imaging prints a background image 134 on the pre-inked thermoplastic foam 130 by heating with image-wise modulated energy the pre-inked thermoplastic foam 130, preferably, a plurality of layers of the open-cell pre-inked thermoplastic foam 130. This allows an image 138 to be formed of open cells 132 and a non-image or background 134 to be formed of closed cells. A microprocessor based graphics system may be used to generate the image. A "line" of an image seen on the view screen of the microprocessor normally results in this "line" being formed as a mirror image of the line viewed on the screen, and the mirror image is formed of open cells 132 on the printing plate 140. Similarly those portions of the graphics which are non-images (i.e., black on a black and white monitor) result in the non-image portions 134 being formed of closed or sealed cells.

Figure 12:
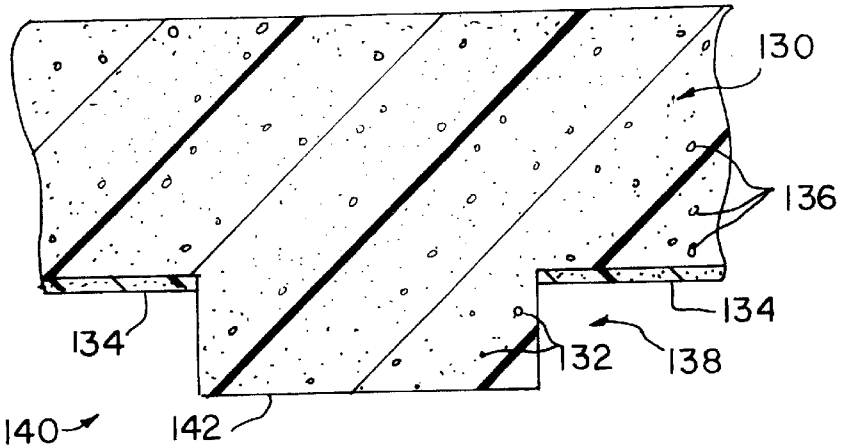
FIG. 12 is a highly enlarged cross section through line 4—4 of FIG. 11 illustrating a letter of the printing plate.
Figure 9:
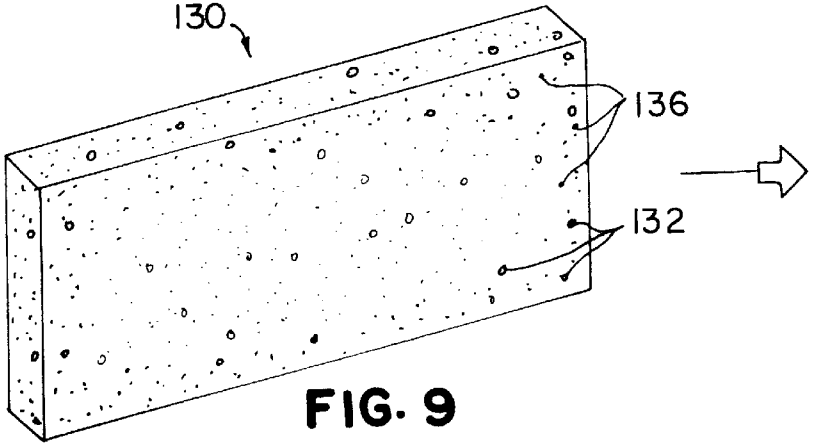
FIG. 9 is an isometric view of a sheet of thermoplastic material which is at least partially saturated with an ink constituent prior to forming an image on the medium.
Figure 11:
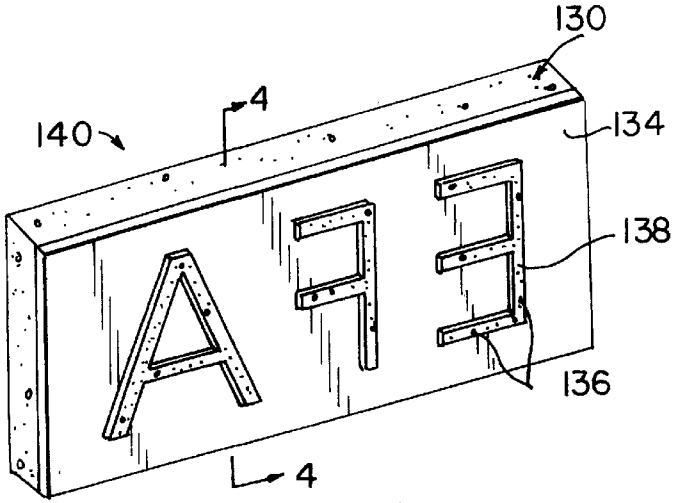
FIG. 11 is an isometric view of the sheet of thermoplastic material which has been processed into a printing plate having a raised open-cell ink effusing face area and a sealed background image.

It is preferable that the printing plate 140 is formed from a sheet of pre-inked thermoplastic foam 130 and the unheated open cell portion 138 is formed as a raised relief image. To accomplish this end, it is more preferable to seal at least a plurality of layers of open cells 132 so that the background portion 134 is formed of at least a plurality of closed cells and depressed, thereby resulting in the image portion 138 being formed as a raised or relief image of open cells. Although the term "layer" as used herein refers to a single layer of open cells, "a plurality of layers" refers to more than just a surface layer of cells. When a plurality of layers are formed, the background portion 134 is not on the same plane as the print surface 142 of image 138. FIG. 12 illustrates this relief concept in a somewhat exaggerated manner.

The pre-inked thermoplastic medium 130 can be formed from a number of thermoplastic resins, including by way of example, and not limitation, polyethylene, polyolefins, polyacytals, polyurethanes, polystyrene, and polyamide. It has been found that an ethylene-olefin copolymer is particularly suitable for the present invention. It is preferable that the thermoplastic medium 130 be "open-celled" prior to the application of heat. In being "open-celled" the thermoplastic medium 130 has interstitial space which may be filled with an ink constituent 136. Many techniques are known for forming open-celled thermoplastic material, including blowing air through the system while the sheet is forming or using a salt-washout technique. The open cells 132 are illustrated in FIGS. 9–12 as large "pores". The thermoplastic medium 126 which has "open cells" 132 is designed to allow an ink constituent 136 to be at least temporarily stored in the thermoplastic medium 126 and transferred to an absorbent material (not shown) at a later time. "Open cell" includes microporous structures which are sufficiently sized to store or transfer ink 136, and cells 132 which are able to communicate directly with other cells 132 or pockets in the thermoplastic foam 130. This allows ink constituent 136 or an emulsified resin to pass from cell 132 to cell 132. The ink constituent 136 is illustrated as black particles for the sake of clarity.

Practically any ink constituent may be used with the present invention. For discussion purposes herein, a black ink comprised of 83% 2-ethyl-1,3-hexandiol, 8.5% solvent black 7 dye, and 8.5% solvent black 5 dye is used. However, selection of an appropriate ink constituent 136 and the amount utilized requires analysis of a number of factors. For instance, a type of ink 136 which conducts heat from the area which is to be melted (background portion 134) to the image forming portion 138 is undesirable. As the ink 136 leaves the open cells of the print plate 140, an ink image is formed on ink absorbing paper. When thermal energy is applied to the surface of the thermoplastic foam 130, the surface of the thermoplastic foam 130 melts or solidifies resulting in melted portion 134 of printing plate 140 which eliminates communication between the ink constituent 136 behind the melted portion 134 of the formed print plate 140 and the print medium. Since portion 134 is substantially impermeable to liquid transfer, these areas are suitable in functioning as non-image areas which are not designed to transfer ink 136. Melting or solidifying a portion of the print face 142 of the thermoplastic medium 126 results in a background image 134 of the thermoplastic foam, substantially preventing communication between the underlying open cells 132 containing ink 136 and the paper. Within the thermoplastic foam 130, the ink 136 moves from one cell 132 to the next and may in fact take a very circuitous route to the material to be printed on.

The image formed on the thermoplastic medium which is to function as a print face is comprised of open cells. Therefore, when placed in contact with a material to be printed on, ink or similar material is transferred from the open cells of the thermoplastic medium to the paper in the desired pattern. Thus, when the thermoplastic medium, including image, is mounted as a printing plate, typically as a hand stamper, the open cell portions of the thermoplastic medium are able to transfer ink to the material to be printed on, i.e., paper, and the sealed portions prevent the transfer of ink. The ink may be contained completely within the piece of thermoplastic foam which forms the stamp or may be fed into the stamp from an ink reservoir.

As an additional and more preferred embodiment of the present invention, the printing device for printing on open-cell thermoplastic foam includes a signal interface assembly for receiving a signal corresponding to an image to be formed on the open-cell thermoplastic foam and a thermal print head driven by the signal. The signal interface assembly is comprised of a communication port, preferably both a parallel port and a serial port which are adapted to receive information, preferably from a microprocessor-based graphics system. One of the more advantageous aspects of the present invention is that essentially any software can be used to generate the image to be formed on the thermoplastic medium. As long as the software can interface with a standard printer (e.g., laser or dot matrix), it can be utilized with the present invention to form a printing plate. The printing device is further comprised of a means for positioning the thermal print head in thermal contact with the open-cell thermoplastic foam, and a drive mechanism for moving the foam across the print head. The thermoplastic foam is placed into a contact position with the thermal print head via the drive mechanism and a cam assembly which is positioned to push the thermal print head against the open-cell thermoplastic foam. Preferably, the electronics of the thermal print head are designed to fire a plurality of times at the same spot on the thermoplastic foam, resulting in a more complete seal without effecting the open cell portions of the thermoplastic foam which are designed to form the image.

Further discussed herein are methods of forming a pattern on an open-cell printing plate which is comprised of generating a signal corresponding to the pattern to be formed on the open-cell printing plate, receiving the signal corresponding to the pattern to be formed on the open-cell printing plate, and driving a thermal head printer to heat the open-cell printing plate to seal at least a layer of cells which correspond to a background of the pattern formed on the open-cell printing plate. Preferably, the printing plate is formed from a piece of thermoplastic foam and the pattern, that is, the unheated open cell portions are formed as raised relief images. To accomplish this, it is preferable to seal a plurality of layers of open cells so that the background portion is formed of a plurality of layers of closed cells.

The present invention may also be characterized as a method of forming a pattern (image 138 and non-image 134) on a pre-inked thermoplastic foam 130. The first step normally includes the steps of designing an image to be reproduced by the stamp pad. Normally, the design step is performed on a conventional computer, using any suitable computer software program capable of yielding the selected results. Normally, the imaging data is routed to a controller in much the same way that the information would be communicated to a printer. Thus, the method specifically includes creating an image associated with a set of electronic data, converting the electronic data into a mirror image of said data and forming said mirror image on a surface of the partially saturated thermoplastic material 130. The formation of the image on the partially saturated thermoplastic foam 130 can occur via a number of standard printing processes which close cells on the thermoplastic foam 130 to form background image 134. These include, but are not limited to, photoflash imaging, engraving, laser etching. The following example is set forth to illustrate the preferred ranges of the ink constituent 136 and its correlation to a select thermoplastic material 130. The examples provided are meant for purposes of illustration and clarification only and are not meant to limit the breadth of the claimed invention in any way.

As an example, a thermoplastic medium 130 comprised of an ethylene-olefin copolymer was used in the following example. The density of the thermoplastic medium 130 was 4.1 grams/inch 3. (Typically of about 2 to about 6 grams/inch 3) Complete saturation of the thermoplastic medium 130 is undesirable because applying very little force results in unwanted effusion of the ink from the thermoplastic material 130. This is especially relevant regarding the use on the thermal head printer 20 of FIG. 2, where the slightest force (i.e., by a roller) would result in unwanted effusion of the ink. It has been found that less than complete saturation is much more desirable. A thermal transfer ribbon 201 may be used (see FIG. 13) to prevent unwanted egress of ink out of the thermoplastic. Early indications from use of photoflash imaging of the pre-inked foam 130 is that the optimal saturation levels are lower for flash than for thermal head printing. The preferable saturation for flash imaging being in the range of 50% to about 75% and more preferably in the range of about 65% to about 70% saturation. When the saturation levels are less than those maximally obtainable (as is the case in the preferred embodiment), it has been found to be preferable to saturate the thermoplastic medium 130 first to the maximally obtainable values, and then displace ink to lower the level to the desired level. This results in more even distribution of the ink 136 in the thermoplastic foam 130. The use of pre-inked foam with laser formation of the image has been shown to be successful.

Although not meant to be bound by theory, it is speculated that during the image forming process (i.e., thermal head printing, photoflash imaging and laser imaging) when the open cells are collapsing to form non-permeable background portion 134, the ink constituent is functioning as a lubricant and as a means to transfer heat. If too much ink is present (i.e., the saturation levels for thermal head printing exceed 80%), the cellular layers do not adequately seal. It should be noted, however, that a small amount of ink, preferably 0.01%, may provide the advantageous lubricating and heat transfer qualities of the present invention, and additional ink 136 may be added after the image (background 134—image 138) are formed. Pre-inking with even a minimal amount of ink 136 is advantageous over the related art because even though inking after image formation is necessary, the capillary action or absorption of the printing plate 140 is more rapid than absorption with a dry ink pad. Therefore, although it is preferable to avoid the necessity of inking the printing plate 140 after image formation altogether (as does the preferred embodiment of the present invention), it is to be recognized that even partially saturating the thermoplastic foam 130, even at minimal levels, provides advantages over the related art.

Utilizing a pre-inked foam as shown in FIG. 10 which is not optimally saturated can result in ink spilling out or egressing out from the thermoplastic foam 26 onto the bed 150 of the printer 20. These unwanted depositions of ink result in an undesirable appearance in the printer 20, may smudge future pieces of thermoplastic foam, interfere with the thermal print head, and may undesirably function as a heat conductor and close cells which are meant to be open. To counteract this, a thermal transfer ribbon 201 may be placed in between the thermoplastic foam 130 and the thermal head and/or printer head to prevent ink from coming in contact with these items. The thermal transfer ribbon 201 keeps the print head free of ink transfer during printing, and adding a layer of wax to the foam aids in sealing the open cells of the background image. Any toner in the wax layer appears irrelevant to optimal function of the present invention and neither enhances or impedes the process.

Figure 13:
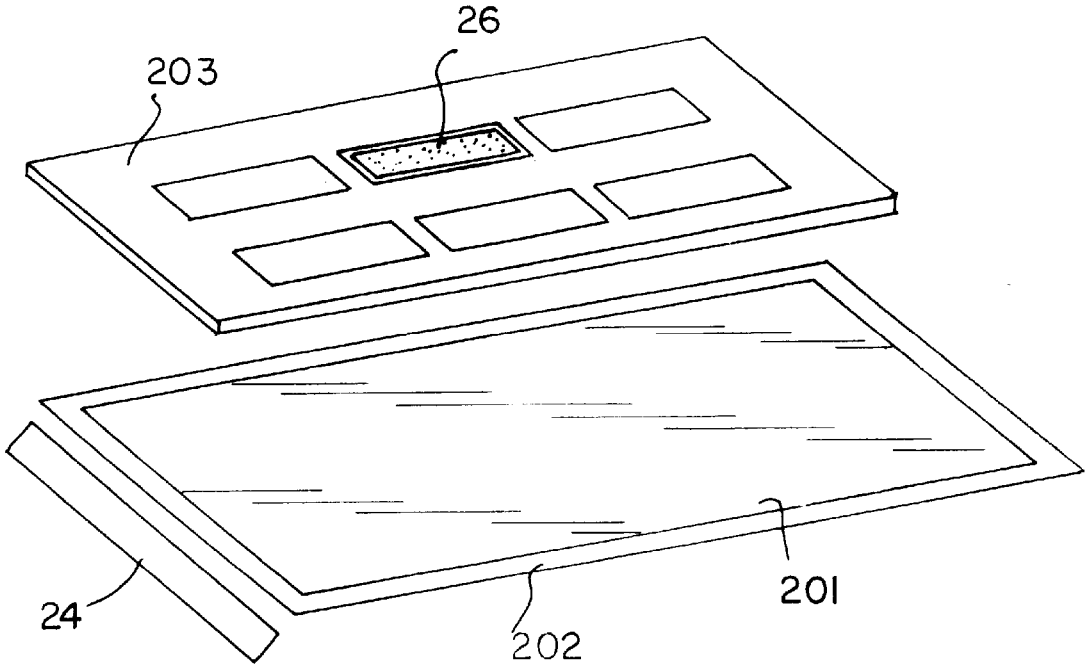
FIG. 13 is an isometric view of a top portion of an alternative embodiment of the present invention wherein a thermal transfer ribbon is interposed between the imaging means and the thermoplastic medium.
Figure 14:
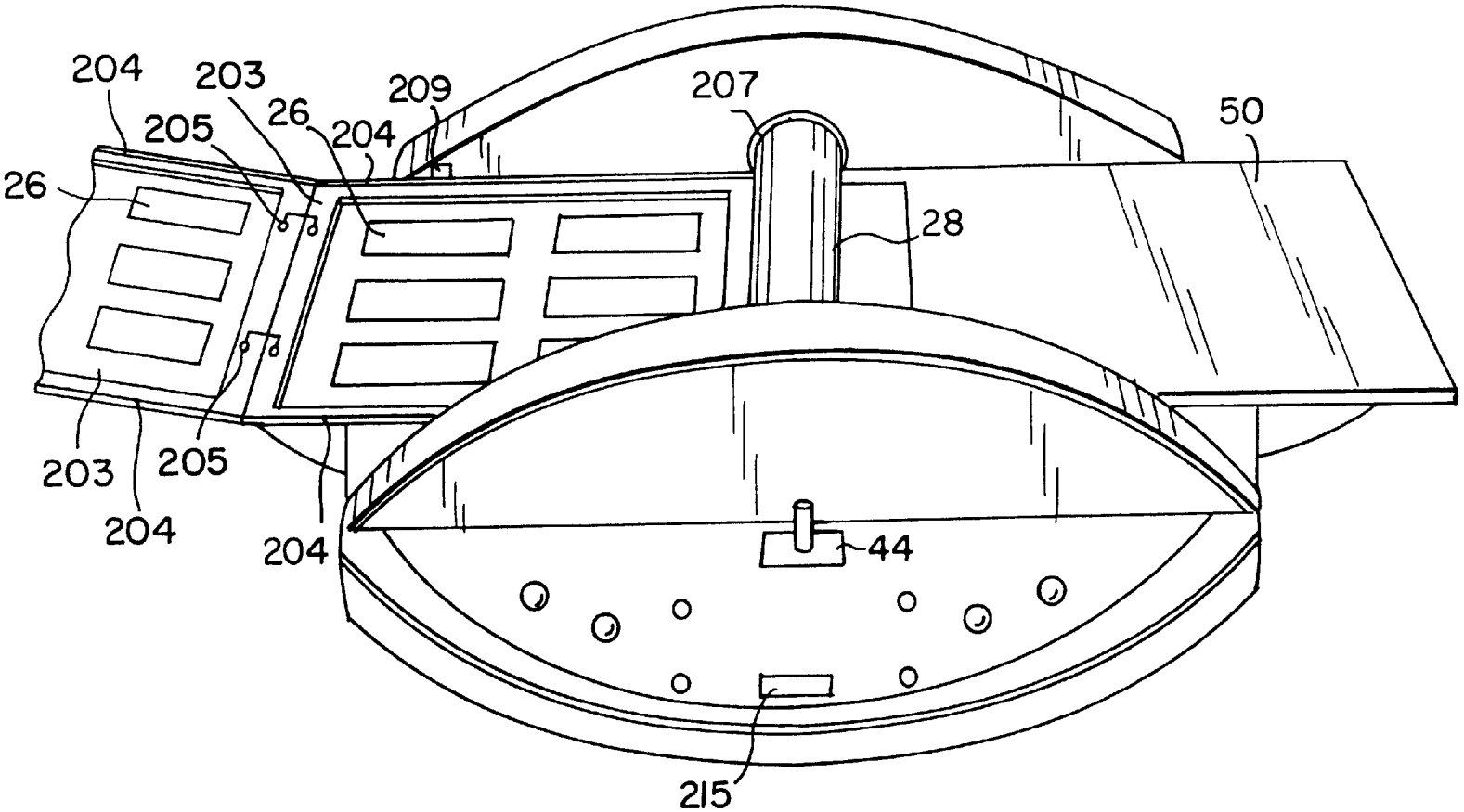
FIG. 14 is a digitized image illustrating a preferred embodiment of the present invention including an aluminum template.

As can be seen in FIG. 13, a template or pallet 203 is preferably used to accommodate various sizes and shapes of thermoplastic foam 26. The use of a pallet allows the foam to be processed in pre-determined pre-cut shapes and avoids the need to cut the thermoplastic foam 26 after is has been processed. The pallet or template 203 can be of any suitable material, but is preferably aluminum. As shown in FIG. 14, pallet 203 has linking means 205 which allows multiple pallets 203 to be hooked together and processed in a continuous run. Using the pallet 203 and pieces of foam 26 sized to finished dimensions avoids the need for cutting or cleaning the stamp. This also allows the stamp to be immediately mounted. As shown in FIG. 14, the template or pallet can have grooves inscribed therein which allow the printer O-rings 207 to guide the pallet through the printer 20. Additionally a photosensor 209 with photo indication can be used to align the template.

Preferably, printer 20 includes enough memory to store one complete image (the entire background 38 and open cell image 48) received from a microprocessor. This is preferable because printing the image a line at a time may result in distortion in the open cell image 48 on printing plate 26. While not meant to be bound by theory, it is speculated that the distortion is a result of either a temperature gradient being set up from one line to the next on the thermoplastic foam 26 during the print process or expansion of the thermoplastic foam 26 as it moves through the printer 20.

The present invention is also directed to a method of forming a pattern on a printing plate wherein the pattern consists of an open-celled portion 48 and closed or sealed portion 38. A signal which corresponds to the pattern to be formed on the printing plate 48 is normally generated with a computer graphics program or other microprocessor system which sends information to driver circuit 64 which in turn communicates with the thermal head 24 and platen roller 28. This provides a large amount of flexibility in the image to be formed on the printing plate 46. The method may include pre-sizing the foam and forming a template to engage the thermoplastic medium. Once the signal is received, the corresponding pattern (image 48 and background image 38) is formed on the printing plate 46. Thermal head 24 of the printer 20 is driven to heat an open-celled thermoplastic medium 26 in order to seal at least a single-surface layer of cells which correspond to the background 38 of the pattern to be formed on the printing plate 46. It is preferable that the open-cell image portion 48 is formed as a relief pattern and therefore does not exist on the same plane as the melted portion or closed cells 38 which form the background image on the printing plate 46.

The thermal printer 20 of the present invention can also be used to print one or more stamp "blanks" that are arranged in a pallet and are printed upon according to a preselected or preprogrammed graphical or textual image created on a microprocessor-based computer system. Although virtually limitless in actual operation, the following pallet, printer, and computer software interaction are described for example purposes with reference to FIGS. 13–14. Preparing the metal pallet 203 and the stamp blanks 26 entails use of the following materials preferably provided with the thermal printer 20 of the present invention: the metal pallet 203, the plastic template divider, the plastic templates (various sizes), the thermal film 201, the pre-inked blanks 26 (various sizes) and the reusable chipboard (note: in FIG. 13, the metal pallet, plastic templates, and template divider are shown pre-assembled as template). To prepare the metal pallet 203, it is placed flat side down. The thermal film 201 is placed over the top of the metal pallet 203 with the dull side of the film 201 facing up. The plastic template divider is placed over the film 201, fitting it down into the recess of the metal pallet 203. The plastic template(s) are fitted in the plastic template divider, choosing the desired sizes of templates. The chosen sizes of plastic templates should match the layout templates selected by the user on the attached computer. Again, sizes of templates can be mixed. If two plastic templates are used, they should preferably be placed on opposing sides of the plastic template divider. The first template that runs through the thermal printer 20 according to the present invention corresponds to the left layout template on the computer screen. Matching size pre-inked stamp blanks 26 are then positioned in the cut-out areas of the template. Each pre-inked blank 26 preferably has one side with rounded edges. It is preferable to place this rounded edge down against the film 201. Finally, a piece of reusable chipboard is placed over the pre-inked stamp blanks 26, over the cutout areas of the template.

The now completed pallet 203 is placed on the thermal printer 20 in the desired location and under the printhead drive roller 28 so that the notched edge 204 is detected by the sensor 209. A pressure adjustment knob 44 is pushed, preferably to the right, as far is possible. A knob on the right side of the thermal printer can be pulled to release the pressure adjustment knob. The pallet 203 is slid underneath the printhead drive roller 28 so that the O-rings 207 fit into the grooves provided on the pallet 203. The notch on the pallet 204 is desired to be to the left of the sensor 209 on the thermal printer 20 before operation thereof. Then, the pressure adjustment knob 44 is pushed as far as possible, and preferably released when resistance is felt.

After the print job has been sent to the thermal printer 20 in accordance with the steps outlined above, and the pallet 203 is in place, the following steps for operation of the thermal printer 20 are engaged. The print width button is adjusted so that the display window 215 shows at least "4.00". The START button is then pushed. The pallet will run through the printer drive roller 28 and stop automatically. The run time through the printer drive roller 28 preferably takes approximately two minutes. When the thermal printer stops, use of the manual feed button will completely release the pallet.

It is to be noted that pallets 203 can be linked by linking means 205 for multi-printing by sending multiple print jobs from the computer. The linked pallets can be fed into the printer 20 by way of an elongated feeder bed which can be either an extended version of the existing feeder bed 50 or a separate additional feeder bed.

To mount the pre-inked stamps 26, processed in accordance with the preferred steps above, the printed pre-inked stamps/dies are removed from the pallet 203 and the thermal film 201 is removed. If the thermal film 201 is excessively wrinkled, this may be an indication that the pressure applied via the pressure adjustment knob 44 was too high, requiring adjustment before the next print job. The printed pre-inked stamps can be mounted to the selected stamp mounts which are commonly known in the art (not shown) using a cyanoacrylate or other rubber-based adhesive to the base area.

To remove excess ink from the stamp, the stamp can be stamped several times. If the stamp printing is spotty or otherwise non-uniform, the inked characters can be cleaned by stamping the stamp onto common adhesive-type tape. If the edges of the stamp are printing, or are not completely sealed, the pressure applied via the pressure adjustment knob 44 was too low, requiring adjustment on the next print job.

Although the invention has been described in terms of particular embodiments in an application, one of ordinary skill in the art, in light of this teaching, can generate additional embodiments and modifications without departing from the spirit of, or exceeding the scope of, the claimed invention. For instance, it is within the scope of the present invention to utilize an automatic sensor (e.g., 209) to determine the thickness and width of the thermoplastic medium 26 and to use a variety of temperatures and speed of processing depending on the thermoplastic medium 26. Additionally, information regarding the status of the machine and the production commands can be part of a Liquid Crystal Display ("LCD") format 215 or Graphical User Interface format ("GUI").

It is to be understood that the drawings and the descriptions herein are proffered by way of example only to facilitate comprehension of the invention and should not be construed to limit the scope thereof.

What is claimed is:

1. A printer assembly for printing on a thermoplastic medium comprising:

a frame;

a thermal head attached to said frame, said thermal head used for applying thermal energy to the thermoplastic medium to seal a selected portion of the thermoplastic medium; and a pallet, said pallet adapted to accommodate the thermoplastic medium.

2. The printer assembly of claim 1, further including means for driving the pallet through the printer assembly such that the thermoplastic medium contained in the pallet moves across the thermal head.

3. The printer assembly of claim 1, further including means for guiding the pallet through the printer assembly.

4. The printer assembly of claim 1, wherein the pallet can accommodate a plurality of thermoplastic media.

5. The printer assembly of claim 1, further including a signal interface assembly for receiving a signal corresponding to an image to be formed on said thermoplastic medium.

6. The printer assembly of claim 1, further including a roller for driving the pallet through the printer assembly.

7. The printer assembly of claim 6, further including at least one ring disposed on the roller and received in a groove defined by the pallet.

8. The printer assembly of claim 2, further including means for guiding the pallet through the printer assembly.

9. A printer assembly for printing on a thermoplastic medium comprising:

a frame;

a thermal head attached to said frame, said thermal head used for applying thermal energy to the thermoplastic medium to seal a selected portion of the thermoplastic medium; and a pallet, said pallet comprising at least two pallet assemblies which are mechanically linked together, each of the pallet assemblies being adapted to accommodate a thermoplastic medium.

10. A printer assembly for use on an open-celled thermoplastic medium comprising:

a frame;

a thermal head attached to said frame, said thermal head used for applying thermal energy to the thermoplastic medium to seal a selected portion of the thermoplastic medium;

a pallet, the pallet adapted to carry the open-celled thermoplastic medium in close proximity past the thermal head; and a roller for driving the pallet through the printer assembly.

11. The printer assembly of claim 10, further including at least one ring disposed on the roller and received in a groove defined by the pallet.

12. The printer assembly of claim 10 further comprising adjustable guide rails operatively connected to the frame, the guide rails adapted to accommodate a selected width of the pallet and to guide the pallet through the printer assembly.

13. The printer assembly of claim 10 wherein the pallet can accommodate a plurality of thermoplastic media.

14. The printer assembly of claim 10, wherein the pallet comprises at least two pallet assemblies which are mechanically linked together, each of the pallet assemblies being adapted to accommodate a thermoplastic medium.

15. A printer assembly for printing on a thermoplastic medium comprising:

a frame;

a thermal head attached to said frame, said thermal head used for applying thermal energy to the thermoplastic medium to seal a selected portion of the thermoplastic medium;

a pallet, said pallet comprising at least two pallet assemblies which are mechanically linked together, each of the pallet assemblies being adapted to accommodate a thermoplastic medium;

a driving means for driving the pallet assemblies containing the thermoplastic media across the thermal head; and a photosensor, said photosensor providing information relating to positioning of the thermoplastic medium.

16. In system comprising a thermal head printer operably connected to a frame, a method of forming a pattern on a printing plate, said printing plate comprising an open-celled thermoplastic medium, said method comprising:

pre-inking the open-celled thermoplastic medium to a saturation level less than about 5 percent;

activating a thermal head printer to seal a layer of cells corresponding to a background of the pattern to be formed on the printing plate thereby forming the pattern on the printing plate; and inking the open-celled thermoplastic medium to a saturation level of about 100 percent.

17. The method of claim 16 wherein the open-celled thermoplastic medium is pre-inked to a saturation level in the range from about 5 percent to about 50 percent.

18. The method of claim 16 wherein the open-celled thermoplastic medium is pre-inked to a saturation level in the range from about 50 percent to about 75 percent.

19. The method of claim 16 further including the steps of:

placing the pre-inked open-celled thermoplastic medium on a pallet; and driving the pallet such that the pre-inked open-celled thermoplastic medium on the pallet moves in close proximity past the thermal head printer during the activation of the thermal head printer.

20. The method of claim 19 further comprising the steps of:

placing first and second pre-inked open-celled thermoplastic media on first and second pallets, respectively;

connecting the first and second pallets; and driving the pallets such that the pre-inked open-celled thermoplastic media on the pallets move in close proximity past the thermal head printer during the activation of the thermal head printer.

* * * * *